US008602849B2

(12) United States Patent
Wolber

(10) Patent No.: US 8,602,849 B2
(45) Date of Patent: Dec. 10, 2013

(54) FINISHING DEVICE FOR FINISHING A SURFACE OF A WORKPIECE

(75) Inventor: Simon Wolber, Wolfach (DE)

(73) Assignee: Supfina Grieshaber GmbH & Co. KG, Wolfach (DE)

( * ) Notice: Subject to any disclaimer, the term of this patent is extended or adjusted under 35 U.S.C. 154(b) by 233 days.

(21) Appl. No.: 13/155,892

(22) Filed: Jun. 8, 2011

(65) Prior Publication Data

US 2011/0312256 A1 Dec. 22, 2011

(30) Foreign Application Priority Data

Jun. 22, 2010 (EP) ..... 10166872

(51) Int. Cl.
*B24B 21/08* (2006.01)

(52) U.S. Cl.
USPC ..... 451/303; 451/49

(58) Field of Classification Search
USPC ..... 451/49, 62, 168, 173, 174, 307, 303, 451/296
See application file for complete search history.

(56) References Cited

U.S. PATENT DOCUMENTS

| | | | | | |
|---|---|---|---|---|---|
| 4,979,335 | A | * | 12/1990 | Weber et al. | 451/324 |
| 5,522,762 | A | * | 6/1996 | Pineau | 451/163 |
| 5,683,291 | A | * | 11/1997 | Humpert et al. | 451/168 |
| 5,695,391 | A | * | 12/1997 | Steinwender | 451/168 |
| 6,080,051 | A | * | 6/2000 | Weber | 451/303 |

FOREIGN PATENT DOCUMENTS

| | | | |
|---|---|---|---|
| DE | 38 13 484 | A1 | 11/1989 |
| DE | 196 02 974 | A1 | 7/1997 |
| EP | 1 518 643 | A1 | 3/2005 |

* cited by examiner

*Primary Examiner* — Robert Rose
(74) *Attorney, Agent, or Firm* — Henry M. Feiereisen LLC

(57) ABSTRACT

A finishing device for finishing a surface of a workpiece includes a finishing belt, and a guide unit for guiding the finishing belt. The guide unit has a cup-shaped guide surface which bounds a receiving zone for the workpiece and along which the finishing belt is guided or guidable between an entry zone and an exit zone. The guide unit includes at least two separate guide members which have each a surface area, with the surface areas of the guide members jointly defining the guide surface and being movable relative to one another.

15 Claims, 3 Drawing Sheets

FINISHING DEVICE FOR FINISHING A SURFACE OF A WORKPIECE

CROSS-REFERENCES TO RELATED APPLICATIONS

This application claims the priority of European Patent Application, Serial No. EP 10166872.1, filed Jun. 22, 2010, pursuant to 35 U.S.C. 119(a)-(d), the content of which is incorporated herein by reference in its entirety as if fully set forth herein.

BACKGROUND OF THE INVENTION

The present invention relates to a finishing apparatus for finishing a surface of a workpiece.

It would be desirable and advantageous to provide an improved finishing apparatus to obviate prior art shortcomings.

SUMMARY OF THE INVENTION

According to one aspect of the present invention, a finishing device for finishing a workpiece surface includes a finishing belt, and a guide unit for guiding the finishing belt, the guide unit having a cup-shaped guide surface which bounds a receiving zone for the workpiece and along which the finishing belt is guided or guidable between an entry zone and an exit zone, wherein the guide unit includes at least two separate guide members which have each a surface area, with the surface areas of the guide members jointly defining the guide surface and being movable relative to one another.

The guide members of a finishing apparatus according to the present invention can thus be moved independently from one another. As a result, the respective surface areas of the guide surface can be configured of particularly large dimensions and at the same time are able to act upon the finishing belt along their course with evenly distributed contact pressures so that the finishing belt can be pressed along its course about the workpiece surface to be treated evenly against the workpiece surface. As a consequence, the effective area of the finishing belt is enlarged while at the same time the contact pressure and thus the material removal capacity are increased.

According to another advantageous feature of the present invention, the guide members can be configured so as to be movable between an idle position and an operative position, with the guide surface extending in the idle position of the guide members between the entry zone and the exit zone over a first circumferential angle which permits introduction of the workpiece into the receiving zone and discharge of the workpiece from the receiving zone, and with the guide surface extending in the operative position of the guide members for treating the workpiece over a second circumferential angle which is greater than the first circumferential angle. The provision of a first smaller circumferential angle ensures that the workpiece can more easily be introduced into the receiving zone and withdrawn therefrom. The second greater circumferential angle enables an enlargement of the effective area of the finishing belt, thereby realizing a particularly high material removal capacity.

According to another advantageous feature of the present invention, the first circumferential angle can be equal to or smaller than 180° so that a workpiece to be treated can be introduced into the receiving zone and withdrawn therefrom free of undercuts. As a result, the finishing apparatus is easy to handle.

According to another advantageous feature of the present invention, the second circumferential angle may be greater than 180°. Currently preferred is a circumferential angle of more than approximately 200°. This results in a particularly large-area guide surface with a great wrap-around angle (equals the second circumferential angle), accompanied by a high material removal capacity. When at the same time the first circumferential angle is smaller or equal 180°, workpieces can be introduced free of undercuts into the receiving zone despite the substantial wrap-around angle during treatment.

The presence of a wrap-around angle or second circumferential angle of greater than 180° meets highest standards with respect to roundness. In addition, it is possible to work on not only rotation-symmetrical, e.g. cylindrical, workpiece surfaces but also on workpiece surfaces which in circumferential direction have only segments that are rotation-symmetrical. Such workpiece surfaces may, for example, be provided on balancer shaft bearings which have a part-cylindrical section and a flat section, as viewed along their circumference. Such workpiece surfaces may also be labeled as half-seat or part-seat as opposed to a full seat. By wrapping such a workpiece surface with a second circumferential angle of greater than 180°, undesired migration and/or tilting of such a workpiece surface with components of the guide unit is prevented.

According to another advantageous feature of the present invention, the guide unit has a maximum of two separate guide members. These guide members have neighboring surface areas which are however not connected and may each extend over a circumferential angle of greater than 90°.

According to another advantageous feature of the present invention, a holder can be provided to movably support at least one of the guide members. This results in a particularly simple construction of the guide unit. Currently preferred is a movable support of all guide members of the guide unit on the holder.

According to another advantageous feature of the present invention, a holder can be provided to swingably support at least one of the guide members. Currently preferred is a swingable support of all guide members of the guide unit on the holder. This configuration results in an especially suitable geometry, useful for treating workpieces that have at least one rotation-symmetrical section. Advantageously, the pivot axes may be oriented in substantial parallel relationship to a workpiece axis of a workpiece received in the receiving zone.

According to another advantageous feature of the present invention, the at least one of the guide members can be swingable about a first axis, and the workpiece in the receiving zone is defined by a second axis in parallel relationship to the first axis, with the first and second axes defining a plane which intersects at least in approximation in midsection the surface area of the at least one of the guide members. In this way, the contact pressure is evenly distributed.

According to another advantageous feature of the present invention, a force-application mechanism may be provided for holding the guide members in the idle position. This is beneficial because the guide members can be kept, without influence by a workpiece, in their idle position, accompanied with the first, i.e. smaller, circumferential angle. This greatly simplifies introduction of a workpiece to be treated into the receiving zone.

According to another advantageous feature of the present invention, the guide members can be transferred from the idle position to the operative position by the workpiece surface when the workpiece is placed in the receiving zone. This is advantageous because it eliminates the need for the provision of a principally conceivable but more complex drive to implement the transfer of the guide members from the idle position to the operative position. Thus, the workpiece surface to be treated can be utilized to press against the finishing belt which in turn is pressed against the surface areas of the guide members. This means that the guide members are transferred from the idle position to the operative position solely by the force applied by the workpiece, possibly in opposition to the action of an afore-mentioned force-application mechanism.

According to another advantageous feature of the present invention, the guide surface may have at least one area which yields elastically in a radial direction so as to be malleable. As a result, the workpiece surface can be treated in a particular gentle manner. The elastic resilience may be realized for example by making the surface areas of the guide surface of elastically malleable material, such as elastomer.

According to another advantageous feature of the present invention, at least one of the guide members can be supported in an elastically yielding manner in a radial direction. In this way, the spatial position of a bearing axis of a guide member can be adjusted, at least slightly, to effect a particularly gentle and very precise treatment of the workpiece surface.

A finishing apparatus according to the present invention is applicable for finishing a rotation-symmetrical workpiece surface, which may be cylindrical or spherical. A finishing apparatus according to the present invention may also be applicable for finishing a segment of a rotation-symmetrical workpiece surface, as viewed in a circumferential direction.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
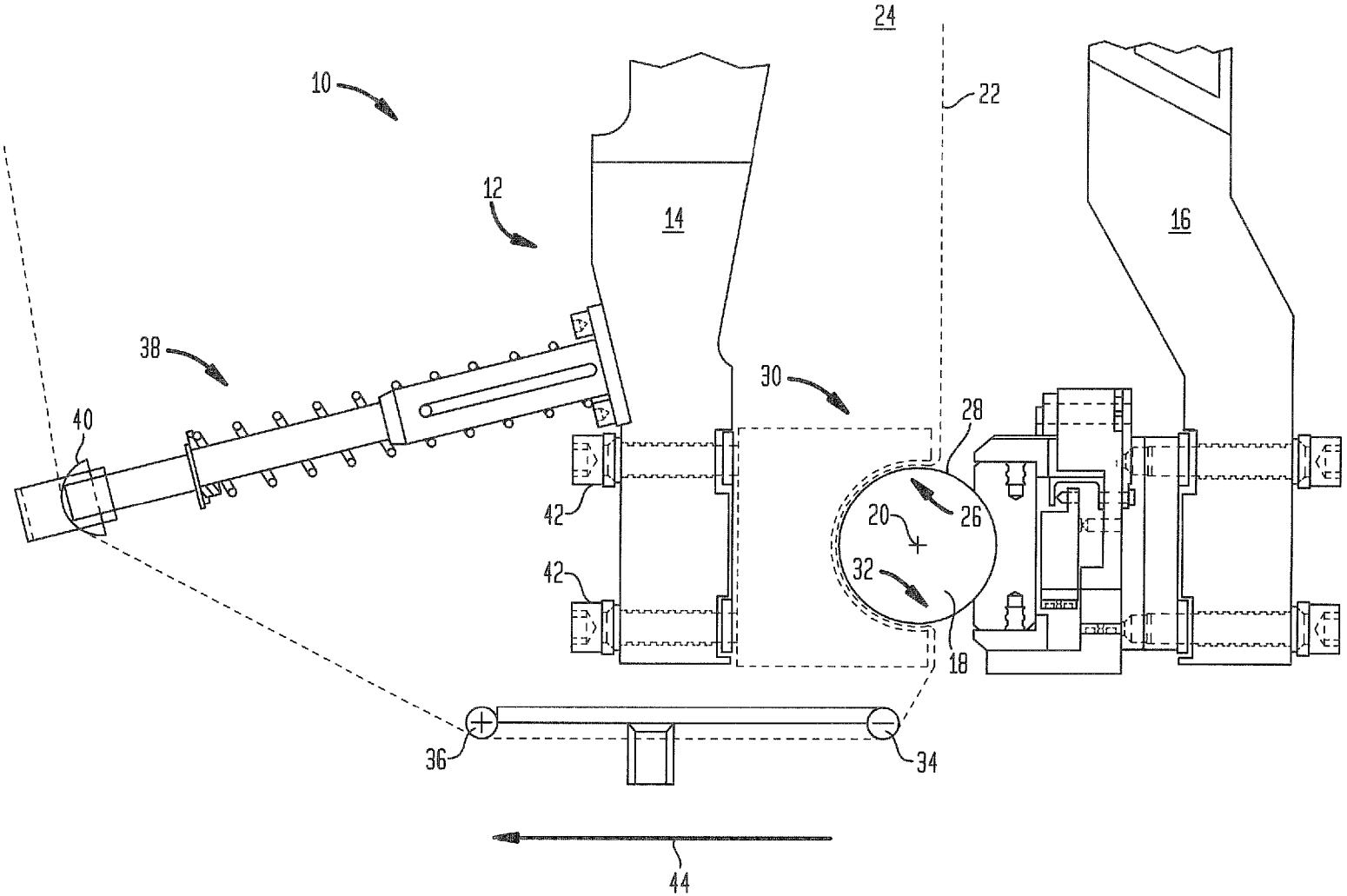
FIG. 1 is a side view of a finishing apparatus with a guide unit, shown schematically.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a side view of a finishing apparatus, generally designated by reference numeral 10. The finishing apparatus 10 includes a pressing device, generally designated by reference numeral 12 and provided with at least one arm 14 and an optional second arm 16. The arms 14, 16 are swingably supported so as to be movable in a direction towards a workpiece 18 which defines a central workpiece axis 20. The workpiece 18 may involve for example a crankshaft having a center bearing or pin bearing to undergo a finishing process. The workpiece surfaces to be treated may be configured as full seat having a workpiece surface which is cylindrical about its entire circumference or as part-seat having a workpiece surface with segments of cylindrical configuration about the circumference.

The finishing apparatus 10 includes a finishing belt 22 which is shown in dash-dot line in FIG. 1. The finishing belt 22 originates from a finishing belt source 24 and routed in substantial radial direction towards the workpiece 18 and brought into contact in the region of an entry zone 26 for the finishing belt 22 with a workpiece surface 28 to be treated of the workpiece 18. The finishing belt 22 is routed starting from the entry zone 26 between a guide unit 30, schematically indicated in FIG. 1 only by a broken line, and the workpiece surface 28 and up to a finishing belt exit zone 32. In the region of the exit zone 32, the finishing belt 22 is routed away from the workpiece surface 28 substantially radially outwards and away from the workpiece 18.

The further course of the finishing belt 22 leads over deflection rollers 34, 36, with a tensioning device 38 tightening the finishing belt 22. The tensioning device 38 has a tension element 40 which acts upon the finishing belt 22 and serves at the same time as a deflection element. The tensioning device 38 is firmly connected with the first arm 14.

The guide unit 30 is mounted onto the first arm 14, for example by a threaded connection 42.

When undergoing the finishing process, the workpiece 18 is caused to rotate about the workpiece axis 20 by a not shown drive unit. The finishing belt 22 may either be at a standstill or moved in a direction indicated by arrow 44 to increase the cutting speed during treatment of the workpiece surface 28. The arm 14 of the pressing device 12 applies in the direction of the workpiece 18 a contact force by which the guide unit 30 applies a pressure upon the finishing belt 22 and by which the finishing belt 22 applies a pressure upon the workpiece surface 28.

The configuration of the guide unit 30 will now be described in greater detail with reference to FIGS. 2 and 3.

Figure 2:
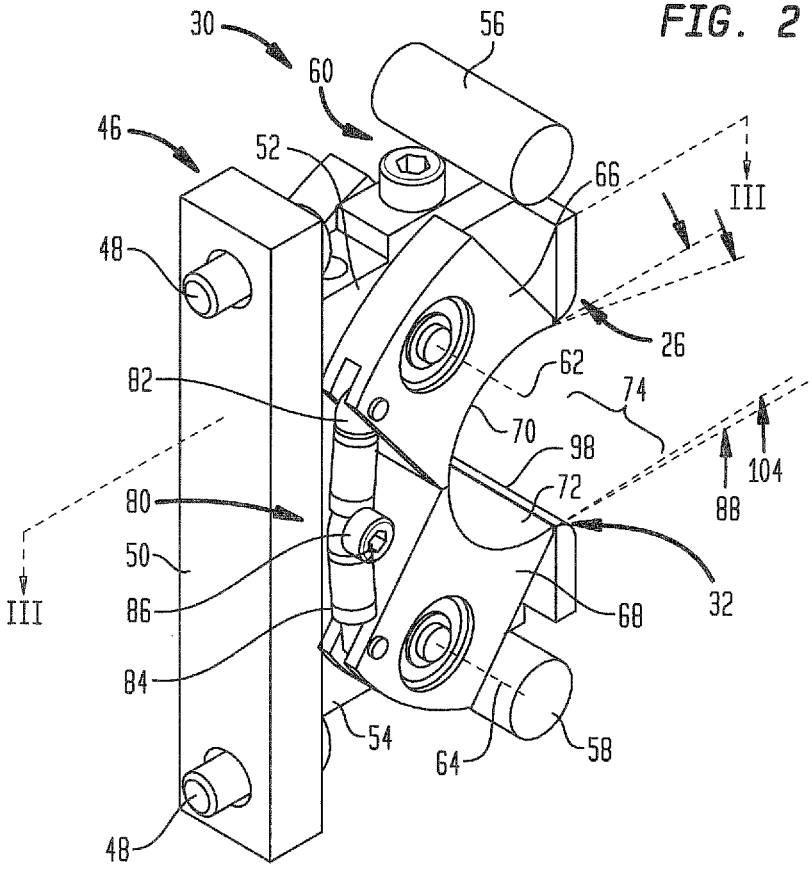
FIG. 2 is a perspective illustration of the guide unit of FIG. 1.

The guide unit 30 includes a holder 46 which is connectable to the first arm 14, for example by screw fasteners 42, shown in FIG. 1, and/or screw fasteners 48, shown in FIG. 2. The holder 46 has for example a substantial C-shaped configuration and includes a rear plate 50 and two supports 52, 54 extending out from the plate 50. The supports 52, 54 are provided to bear further components to be described hereinafter. Secured to the supports 52, 54 are deflection rollers 56, 58 through intervention of mountings 60, respectively. The holder 46 is also provided to establish pivot axes 62, 64 which, as shown by way of example, are oriented in parallel relationship. The pivot axes 62, 64 define the bearing axes for guide members 66, 68, respectively, which are swingable about the pivot axes 62, 64, respectively. The guide member 66 has a surface area 70 and the guide member 68 has a surface area 72, with the surface areas 70, 72 forming jointly a guide surface 74 which extends between the entry zone 26 and the exit zone 32 for the finishing belt 22. The surface areas 70, 72 adjoin one another but are independently movable from one another.

Support of the guide members 66, 68 on the holder 46 may be realized by bearing pins 76 (FIG. 3) which extend in coaxial relationship to the pivot axes 62, 64. The bearing pins 76 may be connected in fixed rotative engagement with the support 52 of the holder 46. A particular low-friction support of the guide members 66, 68 is established by the use of rolling-contact bearings such as ball bearings.

The guide unit 30 further includes a force-application mechanism, generally designated by reference numeral 80. In a simplest construction, the force-application mechanism 80 includes at least one spring 82 which maintains the guide members 66, 68 under tension. In this way, the guide members 66, 68 can be held in an idle position. In the non-limiting example shown in FIG. 2, two springs 82, 84 are provided which are fixed in place in relation to the holder 46 and may for example be articulated to an articulation 86.

The ends of the springs 82, 84 in distal relationship to the articulation 86 are respectively connected to the guide members 66, 68. The force-application mechanism 80 generates a tension force to move the surface areas 70, 72 towards one another so as to establish a first circumferential angle 88 defined by the surface areas 70, 72. The circumferential angle 88 is at most approximately 180°, especially maximal 180°.

Figure 3:
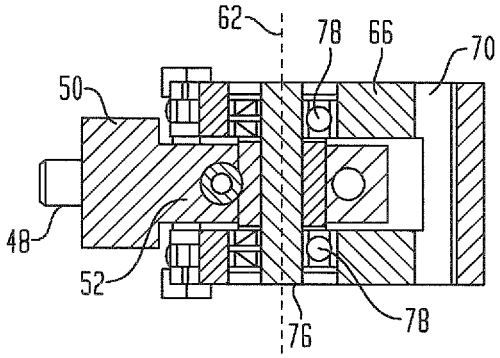
FIG. 3 is a plan view of the guide unit, taken along the line III-III in FIG. 2.
Figure 4:
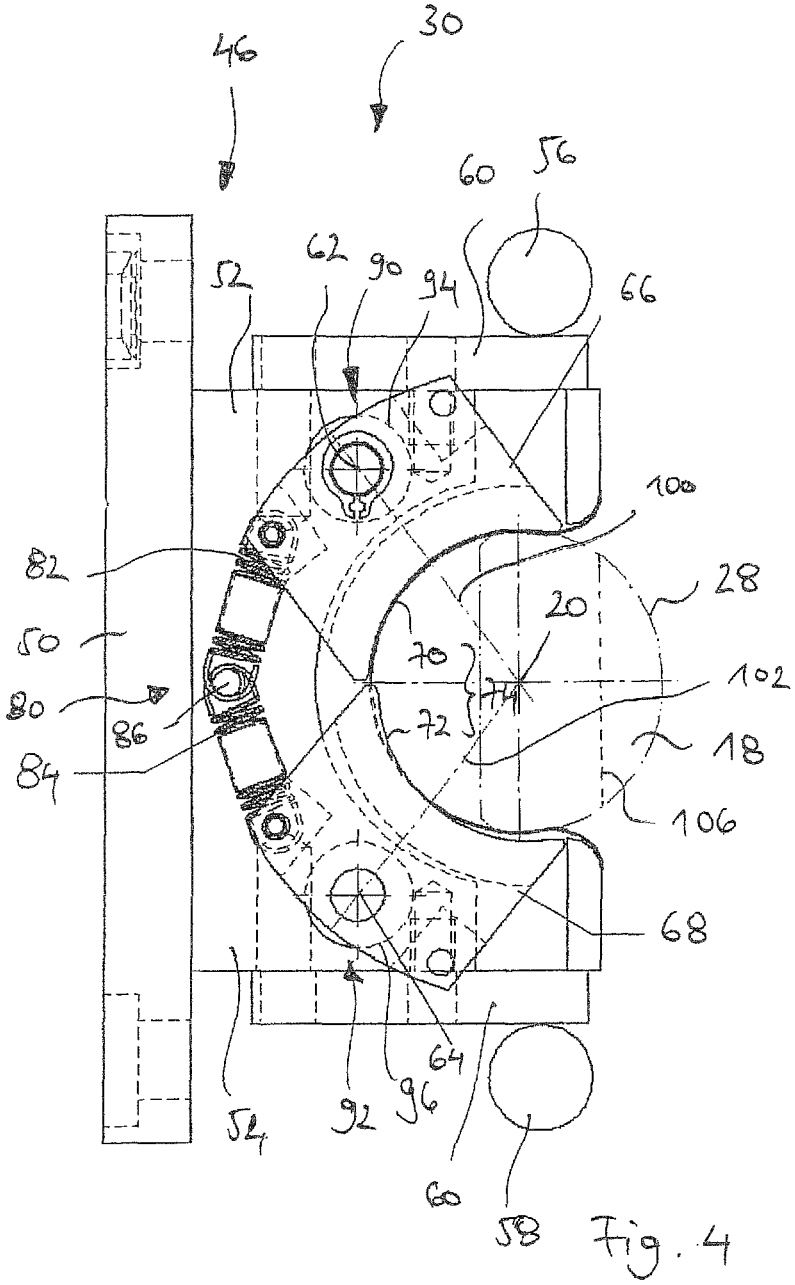
FIG. 4 is a side view of a variation of a guide unit.

Referring now to FIG. 4, there is shown a side view of a variation of a guide unit 30. Parts corresponding with those in FIGS. 2 and 3 are denoted by identical reference numerals and not explained again. The description below will center only on the differences between the embodiments. In this embodiment, provision is made for slide bearings 90, 92 to support the guide members 66, 68, respectively, on the holder 46. In the non-limiting example of FIG. 4, the slide bearings 90, 92 include bearing pins 94, 96, respectively, which are connected in fixed rotative engagement with the holder 46 and on which a bearing surface of the guide members 66, 68 slides so that the guide members 66, 68 are swingable about the pivot axes 62, 64, respectively. The bearing pins 94, 96 may optionally be guided in elastic bearing bushings which permit a radial mobility of the pivot axes 62, 64.

Otherwise, structure and mode of operation of the guide unit 30 according to FIGS. 2 and 3 is the same as the structure and mode of operation of the guide unit 30 according to FIG. 4 so that the following description is applicable to both embodiments.

The guide surface 74 formed by the surface areas 70, 72 bounds a receiving zone 98 (FIG. 2) which receives the workpiece 18 (FIG. 4). The disposition of the pivot axes 62, 64 is selected such that respective imaginary planes 100, 102, in which the pivot axes 62, 64 and the workpiece axis 20 are oriented in substantial parallel relationship, intersect the surface areas 70, 72 at least in approximation in midsection thereof.

FIG. 4 shows the lower guide member 68 in its idle position. The surface area 72 of the guide member 68 is hereby inclined so as to enlarge the receiving zone 98 and thereby facilitate introduction of workpiece 18 into the receiving zone 98. As the workpiece 18 is introduced into the receiving zone 98, the workpiece surface 28 comes into contact with the finishing belt 22, which is not shown in FIGS. 2 and 4 for ease of illustration, so that the finishing belt 22 in turn comes into contact with the surface areas 70, 72 of the guide members 66, 68, respectively. As a result, the guide members 66, 68 are moved from their idle position to their operative position. FIG. 4 shows the operative position with respect to the upper guide member 66. In the operative position, the surface areas 70, 72 embrace the workpiece 18 at a second circumferential angle 104 which is greater than the first circumferential angle 88, shown in FIG. 3.

The second circumferential angle 104 is advantageously selected to exceed 180°.

In the operative position of the guide members 66, 68, the workpiece surface 28 of the workpiece 19 undergoes a finishing operation. The workpiece surface 28 may be configured entirely rotation-symmetrical or may only have segments of rotation-symmetrical configuration and a section 106 shown in FIG. 4 by dashed line and deviating from a rotation-symmetric configuration. When working on a workpiece 18 that is not entirely rotation-symmetrical, the swinging support of the guide members 66, 68 renders it possible for the guide members 66, 68 to execute a pendulum motion, with the guide members 66, 68 moving back and forth alternatingly as a result of the action of a rotation-symmetrical section of the workpiece surface 28 and the action of the force-application mechanism 80.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A finishing device for finishing a workpiece surface, comprising:

a finishing belt;

a guide unit for guiding the finishing belt, said guide unit having a cup-shaped guide surface which bounds a receiving zone for a workpiece and along which the finishing belt is guided or guidable between an entry zone and an exit zone, said guide unit including at least two separate guide members which have each a surface area, said surface areas of the guide members jointly defining the guide surface and being movable relative to one another, wherein the guide members are movable between an idle position and an operative position, with the guide surface extending in the idle position of the guide members between the entry zone and the exit zone over a first circumferential angle which permits introduction of the workpiece into the receiving zone and discharge of the workpiece from the receiving zone, and with the guide surface extending in the operative position of the guide members for treating the workpiece over a second circumferential angle which is greater than the first circumferential angle and;

a force-application mechanism for holding the guide members in the idle position without impact of the workpiece.

2. The finishing apparatus of claim 1, wherein the first circumferential angle is equal to or smaller than 180°.

3. The finishing apparatus of claim 1, wherein the second circumferential angle is greater than 180°.

4. The finishing apparatus of claim 1, wherein the second circumferential angle is greater than approximately 200°.

5. The finishing apparatus of claim 1, wherein the guide unit has a maximum of two separate guide members.

6. The finishing apparatus of claim 1, wherein each of the two guide members has a surface area which extends over a circumferential angle of greater than 90°.

7. The finishing apparatus of claim 1, further comprising a holder to movably support at least one of the guide members.

8. The finishing apparatus of claim 1, further comprising a holder to swingably support at least one of the guide members.

9. The finishing apparatus of claim 8, wherein the at least one of the guide members is swingable about a first axis, and the workpiece in the receiving zone is defined by a second axis oriented in parallel relationship to the first axis, said first and second axes defining a plane which intersects at least in approximation in midsection the surface area of the at least one of the guide members.

10. The finishing apparatus of claim 1, wherein the guide members are transferred from the idle position to the operative position by the workpiece surface when the workpiece is placed in the receiving zone.

11. The finishing apparatus of claim 1, wherein the guide surface has at least one area which yields elastically in a radial direction so as to be malleable.

12. The finishing apparatus of claim 1, wherein the area is made of elastomer.

13. The finishing apparatus of claim 1, wherein at least one of the guide members is supported in an elastically yielding manner in a radial direction.

14. The finishing apparatus of claim 1, for finishing a rotation-symmetrical workpiece surface.

15. The finishing apparatus of claim 1, for finishing a segment of a rotation-symmetrical workpiece surface, as viewed in a circumferential direction.

* * * * *